US012006848B2

(12) United States Patent
Scholz

(10) Patent No.: US 12,006,848 B2
(45) Date of Patent: Jun. 11, 2024

(54) DEVICE AND METHOD FOR THE UTILISATION OF LOW-TEMPERATURE HEAT BY DECOUPLING THE LOW-TEMPERATURE HEAT FROM PROCESS GAS, AND USE

(71) Applicants: thyssenkrupp Industrial Solutions AG, Essen (DE); thyssenkrupp AG, Essen (DE)

(72) Inventor: Marco Scholz, Dortmund (DE)

(73) Assignees: thyssenkrupp Uhde GmbH, Dortmund (DE); thyssenkrupp AG, Essen (DE)

( * ) Notice: Subject to any disclaimer, the term of this patent is extended or adjusted under 35 U.S.C. 154(b) by 15 days.

(21) Appl. No.: 17/280,955

(22) PCT Filed: May 13, 2020

(86) PCT No.: PCT/EP2020/063321
§ 371 (c)(1),
(2) Date: Mar. 29, 2021

(87) PCT Pub. No.: WO2020/239444
PCT Pub. Date: Dec. 3, 2020

(65) Prior Publication Data

US 2022/0120199 A1 Apr. 21, 2022

(30) Foreign Application Priority Data

May 29, 2019 (DE) ..... 10 2019 207 957.1

(51) Int. Cl.
*F01K 23/06* (2006.01)
*F01K 3/18* (2006.01)

(52) U.S. Cl.
CPC ..... *F01K 23/064* (2013.01); *F01K 3/188* (2013.01)

(58) Field of Classification Search
CPC ..... F01K 23/064; F01K 3/188
See application file for complete search history.

(56) References Cited

U.S. PATENT DOCUMENTS

2009/0084035 A1 4/2009 Wei
2012/0291433 A1* 11/2012 Meng ..... F03G 6/005 60/671

(Continued)

FOREIGN PATENT DOCUMENTS

DE 60 2004 011 087 T 1/2009
DE 10 2016 218 438 A 3/2018

(Continued)

OTHER PUBLICATIONS

English Translation of International Search Report issued in PCT/EP2020/063321, dated Aug. 13, 2020.

*Primary Examiner* — Hoang M Nguyen
(74) *Attorney, Agent, or Firm* — thyssenkrupp North America, LLC

(57) ABSTRACT

A low-temperature heat utilization assembly may be configured to decouple low-temperature heat from process gas at temperatures below 200° C. and to provide the process gas at a lowered intermediate temperature or at a still further lowered final temperature for at least one subsequent process. In the low-temperature heat utilization assembly the process gas may be fed to a first unit, by means of which the temperature may be lowered to the intermediate temperature. The process gas may in some cases be provided to a heat exchanger stage for further lowering to the final temperature. The first unit is an ORC unit for energy transformation of the heat energy into electrical energy and may be coupled to an electrical consumer unit. The ORC unit may be configured for energy feedback of electrical energy (Continued)

within the low-temperature heat utilization assembly or to a process upstream of the ORC unit.

12 Claims, 2 Drawing Sheets

(56) References Cited

U.S. PATENT DOCUMENTS

| | | | | |
|---|---|---|---|---|
| 2013/0257055 | A1* | 10/2013 | Simpson | F24T 10/10 290/52 |
| 2014/0109575 | A1* | 4/2014 | Balkenende | F01K 13/00 60/645 |
| 2014/0109844 | A1 | 4/2014 | Wall | |
| 2015/0184590 | A1* | 7/2015 | Conlon | F25J 1/0012 60/772 |
| 2015/0377079 | A1* | 12/2015 | Noureldin | C10K 1/046 60/671 |

FOREIGN PATENT DOCUMENTS

| | | |
|---|---|---|
| EP | 1 613 841 B | 12/2006 |
| EP | 2 751 294 B | 8/2017 |

* cited by examiner

DEVICE AND METHOD FOR THE UTILISATION OF LOW-TEMPERATURE HEAT BY DECOUPLING THE LOW-TEMPERATURE HEAT FROM PROCESS GAS, AND USE

CROSS REFERENCE TO RELATED APPLICATIONS

This application is a U.S. National Stage Entry of International Patent Application Serial Number PCT/EP2020/063321, filed May 13, 2020, which claims priority to German Patent Application No. DE 10 2019 207 957.1, filed May 29, 2019, the entire contents of both of which are incorporated herein by reference.

FIELD

The present disclosure generally relates to devices and methods for utilizing low-temperature heat by decoupling the low-temperature heat from process gas.

BACKGROUND

In the field of process engineering, in particular when interconnecting a plurality of plants or processes, in many cases different temperature levels are needed, in particular in each case a very specific, advantageous temperature level for each respective process. Example: linking of hydrogen and pressure swing adsorption plants. In particular, the temperature differences lie for example in the range from 100° C. to 150° C. If the process gas for the subsequent process has to be provided at a lower temperature level, cooling is required. In particular, cooling for example from a temperature level in the range from 150° C. to 200° C. to a temperature level in the range from 25° C. to 50° C. is desired.

Thus, a need exists for a device and a method of which temperature stages in process engineering processes, in particular in the case of series-connected plants, may be elegantly overcome, in particular with regard to energy optimization.

DETAILED DESCRIPTION

Figure 1:
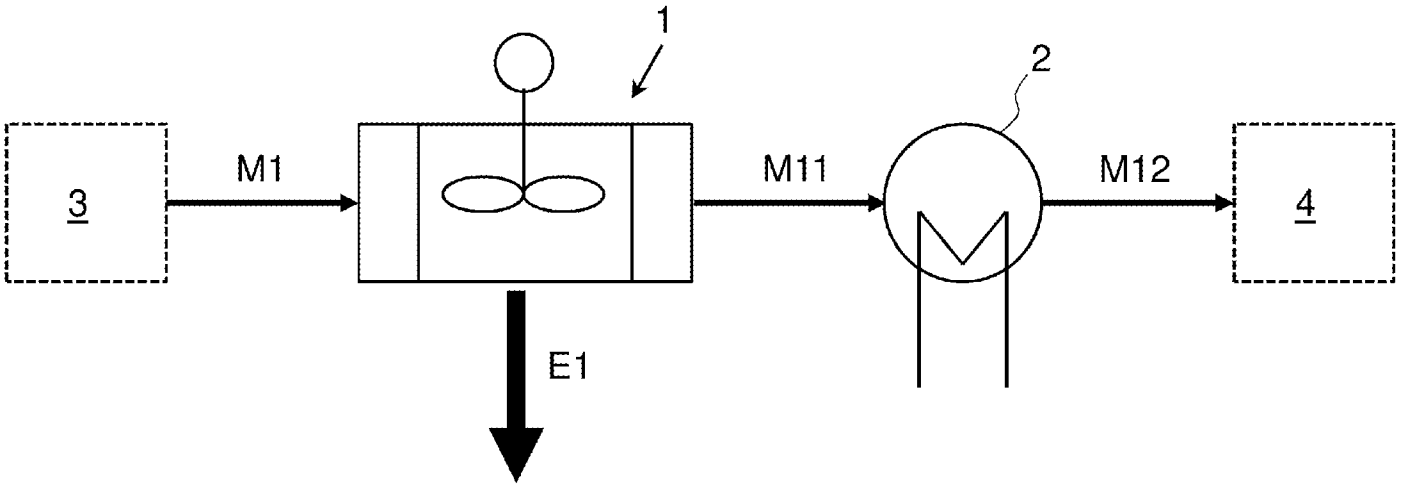
PRIOR ART Fig. 1
FIG. 1 is a schematic diagram relating to a plant/process engineering concept according to the prior art.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims.

In addition, all references to one skilled in the art shall be understood to refer to one having ordinary skill in the art.

The present disclosure generally relates to devices and methods for utilizing low-temperature heat by decoupling the low-temperature heat from process gas, in particular in the context of hydrogen and/or synthesis gas. The present disclosure further relates to the use of a process engineering component, such that energy utilization can proceed particularly advantageously.

In some examples, a low-temperature heat utilization assembly is designed for decoupling low-temperature heat from process gas at temperatures below 200° C. or below 190° C., in particular at process gas temperatures in the range from 150° C. to 170° C., and is designed to provide the process gas at a lowered intermediate temperature, in particular in the range from 80° C. to 100° C., specifically 90° C., or at a still further lowered final temperature, in particular in the range from 30° C. to 40° C., specifically 35° C., for at least one subsequent process, wherein in the low-temperature heat utilization assembly the process gas may be fed to a first unit, by means of which the temperature may be lowered to a/the intermediate temperature, wherein the process gas may optionally be provided to at least one heat exchanger stage for further lowering to a/the final temperature; wherein the first unit is an ORC unit for energy transformation of the heat energy into electrical energy, wherein the ORC unit is coupled to at least one electrical consumer unit or to a line for energy export and/or wherein the ORC unit is designed for energy feedback of electrical energy within the low-temperature heat utilization assembly or to a process upstream of the ORC unit. This yields high energy efficiency and may for example also ensure complete energy self-sufficiency for at least one of a number of coupled-together processes, in particular complete energy self-sufficiency of a hydrogen plant.

This low-temperature heat utilization assembly or the corresponding energy conversion process and the energy recovery achievable therewith may for example be implemented in the context of steam reformer plants.

Organic Rankine processes (Organic Rankine Cycles ORC) are used in the most varied process engineering contexts (for example in combined heat and power plants for biogas use), in particular for low-temperature heat utilization. It has now been identified that there might also be interest in utilization of the advantages of ORC for new applications or in new process or plant engineering contexts.

The assembly according to the invention for example enables the implementation of an ORC process in which the energy of the process gas is transferred directly to the working fluid of the ORC process.

The assembly according to the invention in this case for example also enables implementation of an ORC process in which the energy from the process gas is firstly transferred to an intermediate medium, such as for example a thermal oil, before the energy is transferred from the intermediate medium to the working fluid of the ORC process.

Through the coupling according to the invention of the ORC process with at least one plant in which temperature stages need to be overcome, in particular a hydrogen plant or other process technology, an efficient energy utilization concept may be provided for the provision of electrical energy in process plants. Waste heat flows that were previously conventionally dissipated may in this case be comparatively efficiently transformed into electrical energy and utilized. Interlinking of processes (in series and/or in parallel) is thus of greater interest than with previous plant/process concepts.

The invention is in this case also based on the concept of implementing ORC technology to increase energy efficiency or to recover energy. Although it is economic from the point of view of plant engineering to provide just one conventional cooler and optionally also further heat exchangers, for example, between a hydrogen plant and a pressure swing adsorption plant, it has been found that any increased complexity or increased capital expenditure which may be due to the ORC technology can be quickly compensated over the course of operation of the assembly, for example within a year. In other words, the cost savings resulting from energy savings may cancel out higher capital investment for example within as little as a few months or years, depending on the respective applicable energy price levels.

An appropriate level for the intermediate temperature may in this case in particular be/have been defined as a function of the evaporation temperature of the working fluid, by way of example approx. 80° C. in the case of pentane for example (depending on specified pressure level). An advantageous process gas temperature then amounts for example to 90° C. or 85° C. 80° C., for example, may be stated as the lower limit for the process gas temperature.

An appropriate level for the final temperature, if a two-stage process is to be implemented, may in this case be/have been defined in particular as a function of the type of process arranged downstream of the low-temperature heat utilization assembly, for example in the case of pressure swing adsorption approx. 35° C. to 40° C.

The ORC unit may in this case automatically adjust itself, depending on available heat flow. An integrated closed-loop control concept specific to the ORC unit is not necessarily required. Instead, any closed-loop control-related problems in the context of the present invention may be focused on the feed-in or feedback of the obtained electrical energy.

It has been found that sufficient residual heat may advantageously also be provided in the case of an emergency shutdown, in order to operate boiler feedwater pumps, for example. Thus, dry running of evaporators may be prevented even in the case of an operating failure. In other words, the assembly according to the invention is also comparatively robust and may protect heat exchanger units from disadvantageous operating situations.

According to one exemplary embodiment, the low-temperature heat utilization assembly has a second unit with the at least one heat exchanger stage downstream of the ORC unit, by means of which second unit the temperature of the process gas may be lowered from a/the intermediate temperature to the final temperature. In this way, the concept according to the invention may be appropriately implemented in particular also in the context of pressure swing adsorption plants, namely between a first plant upstream (temperature level for example 150° C. to 200° C.) and a second plant downstream (desired inlet temperature level for example 25° C. to 50° C.).

According to one exemplary embodiment, the low-temperature heat utilization assembly is designed for decoupling of a heat energy flow in the range from 15 MW to 40 MW, in particular 2.5 MW to 55 MW. In this way, a quantity of electrical energy may also be provided which enables a high degree of process self-sufficiency, in particular in the context of hydrogen plants or steam reformer plants.

According to one exemplary embodiment, the low-temperature heat utilization assembly is designed to transform heat energy into electrical energy in a range from 1.5 MW to 4.0 MW, in particular 0.25 MW to 5.5 MW, in particular with a transformation factor in the range from 10% or 0.1, specifically in the range of 10%±5% positive/negative deviation. In this way, a hydrogen plant may in particular be autonomous from an energy standpoint, namely supplied with power solely by the energy recovered from the ORC process.

The thermodynamically maximum possible effective Carnot efficiency may be stated as around 20%. Accordingly, even a level of efficiency in the range of 10% may be described as good and advantageous.

For example, heat energy flows of 2.5 to 40 MW may be used in the configuration according to the invention, whereas hitherto these were in many cases output or dissipated to the surrounding environment wholly unused.

A heat energy flow of 30 MW is for example utilized at an efficiency of 10%, such that 3 MW of electrical power may be provided. The inherent requirement of a hydrogen plant is for example 1.5 MW, such that, in addition to supply of the hydrogen plant, some of the electrical energy may be fed back or exported (combination of a plurality of uses for the electrical energy generated from waste heat).

According to one exemplary embodiment, the low-temperature heat utilization assembly has at least one energy coupling or line by means of which the ORC unit is coupled to further consumers and/or by means of which the low-temperature heat utilization assembly is designed for energy feedback within the low-temperature heat utilization assembly or to a plant upstream of the low-temperature heat utilization assembly. In this way, energy utilization can be further differentiated depending on the field of application.

According to one exemplary embodiment, the low-temperature heat utilization assembly is arranged downstream of a hydrogen plant or synthesis gas plant, wherein the process gas is provided from the hydrogen plant or synthesis gas plant. In this way, an advantageous amount of low-caloric heat may be provided and transformed for the ORC process.

According to one exemplary embodiment, the low-temperature heat utilization assembly is arranged upstream of a pressure swing adsorption plant, wherein the process gas is provided from the low-temperature heat utilization assembly to the pressure swing adsorption plant. In this way, at least two processes may advantageously be interlinked energy-wise, in particular with a hydrogen plant as first process upstream of the low-temperature heat utilization assembly.

According to one exemplary embodiment, the low-temperature heat utilization assembly has an open-/closed-loop control device which is designed for open-/closed-loop control of flows of electrical energy from the ORC process internally in the low-temperature heat utilization assembly or externally. In this way, application-specific energy distribution is closed-loop-controllable in a particularly appropriate manner, in particular also, depending on the situation, as a function of the instantaneous energy requirement of individual consumers. Alternatively, all the recovered electrical energy may be provided to the process upstream of the low-temperature heat utilization assembly.

The above-described object is in particular also achieved according to the invention by a method for utilization of low-temperature heat by decoupling the low-temperature heat from process gas at temperatures of below 200° C. or below 190° C., in particular at process gas temperatures in the range from 150° C. to 170° C., wherein the process gas is provided at a lowered intermediate temperature, in particular in the range from 65° C. to 90° C., or at a still further lowered final temperature, in particular in the range of 35° C., for at least one subsequent process, wherein the process gas is fed to a first unit, by means of which the temperature is lowered to a/the intermediate temperature, wherein the process gas is optionally provided to at least one heat exchanger stage for further lowering to a/the final temperature; with at least one ORC process, which is performed in the first unit for decoupling the low-temperature heat and for providing electrical energy obtained from the low-temperature heat, wherein the electrical energy obtained in the ORC process is fed or exported to at least one electrical consumer unit coupled to the ORC process and/or wherein the electrical energy obtained in the ORC process is fed back within the low-temperature heat utilization process or to a process upstream of the ORC process. This yields the above-stated advantages, in particular an advantageous degree of energy- or process-related self-sufficiency.

Alternatively, all the energy provided by the ORC process, or part thereof, may be exported, i.e. decoupled from the low-temperature heat utilization assembly. The inherent energy requirement of the low-temperature heat utilization assembly may in this case optionally also be covered at least in part by energy imports. In this way, an ideal compromise between coverage of inherent requirements and energy supply to third parties may also be achieved, depending on energy availability.

According to one embodiment, the low-temperature heat is decoupled from the process gas to a/the intermediate temperature, in particular to a temperature of 90° C., wherein the process gas is lowered in a second unit in at least one heat exchange stage to a/the final temperature, in particular to 35° C., in particular to provide the process gas for pressure swing adsorption. This also promotes interconnection with a process downstream of the low-temperature heat utilization assembly, in particular with a pressure swing adsorption plant.

According to one embodiment, a heat energy flow in the range from 15 MW to 40 MW, in particular 2.5 MW to 55 MW is decoupled by the ORC process and transformed into electrical energy, in particular with an energy transformation factor in the range of 10%. According to one embodiment, the ORC process brings about the transformation of heat energy into electrical energy such that electrical energy in a range from 1.5 MW to 4.0 MW, in particular 0.25 MW to 5.5 MW may be provided, in particular with an energy transformation factor in the range of 10% or 0.1. This in each case yields energy of such magnitude that process self-sufficiency can be ensured, with advantageous effects, in particular in the context of steam reformer plants.

The above-described object is also achieved according to the invention by use of at least one ORC unit in a low-temperature heat utilization assembly to decouple heat energy from process gas of a plant, in particular a hydrogen plant or synthesis gas plant, and to provide electrical energy generated from the heat energy to at least one electrical consumer unit and/or to at least partially export the energy and optionally also to feed back (into the process) electrical energy generated from the heat energy into the plant, in particular hydrogen plant or synthesis gas plant, in particular in a previously described low-temperature heat utilization assembly, in particular downstream of a hydrogen plant for energy self-sufficient operation of the hydrogen plant, wherein the ORC unit is used instead of or as a replacement for dissipative cooling devices. Air coolers can be dispensed with, for example. Depending on the situation, distribution of the recovered energy may optionally proceed to suit the energy requirements of the individual consumer units. In particular, energy coupling of at least one first process is ensured, for which heat energy is recovered at the interface to at least one second process and provided as electrical energy.

It has been found that in particular a hydrogen plant may be operated self-sufficiently with regard to energy thanks to the implementation of ORC technology. In other words, all electrical consumer units provided and installed in the hydrogen plant may be supplied by the electrical energy generated using the ORC technology. In this case, implementation of the ORC technology may also be so efficient that excess electrical energy arises, which may be exported from the process. The assembly according to the invention therefore enables a high degree of self-sufficiency and may enable the implementation of plants and processes even when no external power grid is present at all, or an external power grid is unreliable or would lead to high costs. For a start-up process, energy inflow from outside may optionally be provided.

The above-described object is also achieved according to the invention by use of at least one ORC unit in a low-temperature heat utilization assembly to decouple heat energy from the process gas of a hydrogen plant or synthesis gas plant and to provide electrical energy generated from the heat energy in the hydrogen plant or synthesis gas plant for energy-wise self-sufficient operation of the hydrogen plant or synthesis gas plant, in particular in an above-described low-temperature heat utilization assembly. This results, especially in the context of hydrogen plants, in a very advantageous degree of energy self-sufficiency. Stand-alone operation is possible, for example, i.e. operation without external power supply.

FIG. 1 shows by way of example a plant/process engineering structure relating to the provision of process gas, in particular with reference to a hydrogen plant.

Process gas M1 is supplied to a cooler 1 at temperatures of below 170° C. to 190° C., in particular in the range from 150° C. to 170° C., in order to be able to provide the process gas downstream thereof as process gas M11 at a temperature level of for example 65° C. (intermediate temperature). In this case, heat flow is output E1 to the surrounding environment (loss of low-temperature heat), in particular a heat energy loss occurs in the range from 15 MW to 40 MW, in particular 2.5 MW to 55 MW, depending on the plant or the process. Downstream of a heat exchanger stage 2 the process gas M12 is present at a temperature level of for example 35° C. (final temperature) and may be put to further use, for example in a pressure swing adsorption plant or in a synthesis gas compressor. For pressure swing adsorption plants in particular, an advantageous final temperature at the inlet of the plant is in the range from 35° C. to 40° C.

The process gas M1 originates for example from a plant 3 upstream of the energy conversion, in particular from a hydrogen plant. The process gas M12 is fed for example to a plant 4 downstream of the energy conversion, in particular a pressure swing adsorption plant.

Figure 2:
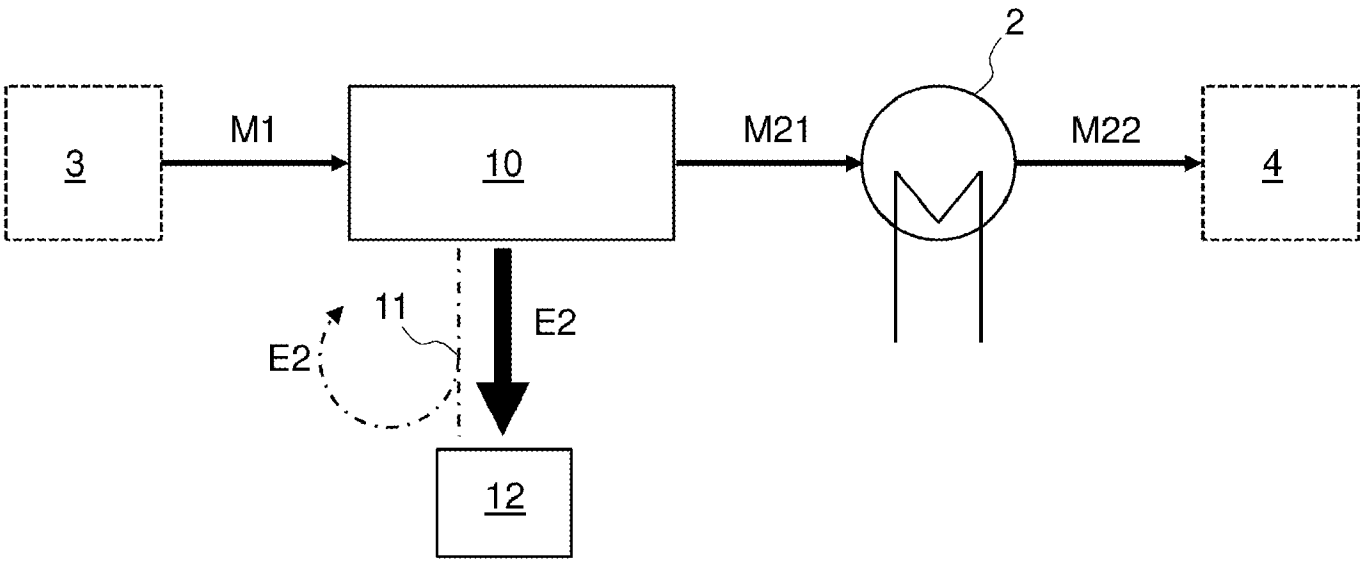
FIG. 2 is a schematic diagram relating to an example plant/process of the present disclosure.

FIG. 2 shows a plant/process engineering structure according to exemplary embodiments of the present invention. At least one ORC process 10 is implemented in a low-temperature heat utilization assembly 100 in such a way that electrical energy obtained from low caloric heat may optionally be exported and/or used in the plant delivering the low caloric heat.

Low-temperature heat (low caloric heat) is used in an ORC process 10 or in a corresponding unit, in particular such that the process gas M21 is cooled down downstream thereof to approx. 90° C. (intermediate temperature). This temperature downstream of the ORC process is defined for example as a function of the type and pressure of a used working fluid. The intermediate temperature is as low as possible, but for many applications is advantageously above 80° C.

Downstream of the heat exchanger stage 2, the forwarded process gas M22 may be present in particular at approx. 35° C., as also in the example of FIG. 1. A heat pump may for example optionally also be installed, in particular in order to raise the temperature level of the process gas M21, in particular from 80° C. to a higher level, if a subsequent process should in a given case require a higher temperature than that of the process gas M21.

The heat energy utilization E2 achievable with the implemented ORC process 10 proceeds in particular by conversion/transformation of the heat energy into electrical energy, in particular for the provision of at least 1.5 MW to 4.0 MW (or 0.25 MW to 5.5 MW) electrical energy from 15 MW to 40 MW (or 2.5 MW to 55 MW) heat energy, in particular with a transformation factor in the range from 10% or 0.1.

The energy flow E2 may be provided for the individual plant/process engineering components or consumer units 12 involved, in particular for a hydrogen plant, and/or the generated electrical energy may be exported from the process described here out to separate external processes/plants or into a power grid independent of the present ORC process. To this end, an energy coupling 11, in particular line may be provided, which connects the ORC unit 10 with the further plant engineering components or processes (in particular within the plant or externally to further consumers).

The process gas M1 originates for example from a plant 3 upstream of the energy conversion, in particular from a hydrogen plant. The process gas M22 is for example fed to a plant 4 downstream of the energy conversion, in particular a pressure swing adsorption plant.

Thanks to the ORC implementation according to the invention, a high degree of self-sufficiency may be ensured. In particular, the present process is independent of an external power supply, and is thus also resistant to mains power variance and unstable power grids. In particular, this may also be very useful at locations with poor infrastructure, or may indeed enable use for the first time of the technology described herein.

LIST OF REFERENCE NUMERALS

1 Cooling apparatus, in particular air cooler
2 Heat exchanger stage
3 Plant or process upstream of the energy conversion, in particular hydrogen plant
4 Plant or process downstream of the energy conversion, in particular pressure swing adsorption plant
10 ORC unit or ORC process
11 Energy coupling, in particular line
12 Electrical consumer unit
100 Low-temperature heat utilization assembly
E1 Heat flow output to the surrounding environment, in particular heat energy loss in the range from 15 MW to 55 MW
E2 Heat energy utilization by conversion/transformation into electrical energy, in particular 1.5 MW to 5.5 MW electrical energy,
in particular transformation factor of 10% or 0.1
M1 Process gas, in particular at a temperature in the range from 150° C. to 170° C.
M11 Actively cooled process gas, in particular at approx. 65° C.
M12 Forwarded process gas, in particular at approx. 35° C.
M21 Actively cooled process gas, in particular at approx. 90° C.
M22 Forwarded process gas, in particular at approx. 35° C.

What is claimed is:

1. A low-temperature heat utilization assembly configured to decouple low-temperature heat from process gas at temperatures below 200° C. wherein the low-temperature heat utilization assembly is configured to receive the process gas from a hydrogen plant being a steam reformer plant located upstream of the low-temperature heat utilization assembly and to provide the process gas at a lowered intermediate temperature to a pressure swing adsorption plant located downstream of the low-temperature heat utilization assembly, the low-temperature heat utilization assembly comprising:

an ORC unit configured to be fed the process gas, wherein the ORC unit is configured to lower a temperature of the process gas to the lowered intermediate temperature, wherein the ORC unit is configured for energy transformation of heat energy into electrical energy, wherein the ORC unit is at least one of:

coupled to an electrical consumer unit or a line for energy export, or configured for energy feedback of electrical energy within the low-temperature heat utilization assembly or to a process in the hydrogen plant located upstream of the ORC unit.

2. The low-temperature heat utilization assembly of claim 1 comprising a second unit with a heat exchanger stage downstream of the ORC unit, wherein the second unit is configured to lower the temperature of the process gas from the lowered intermediate temperature to a final temperature.

3. The low-temperature heat utilization assembly of claim 1 configured to decouple a heat energy flow in a range from 15MW to 40MW.

4. The low-temperature heat utilization assembly of claim 1 configured to transform heat energy into electrical energy in a range from 1.5MW to 4.0MW with a transformation factor in a range from 10% ±5% positive/negative deviation.

5. The low-temperature heat utilization assembly of claim 1 comprising an energy coupling or a line that at least one of:

couples the ORC unit to additional electrical consumer units, or configures the low-temperature heat utilization assembly for energy feedback within the low-temperature heat utilization assembly or to the hydrogen a-plant upstream of the low-temperature heat utilization assembly.

6. The low-temperature heat utilization assembly of claim 1 comprising an open-/closed-loop control device that is configured for open-/closed-loop control of flows of electrical energy from an ORC process in the low-temperature heat utilization assembly.

7. A method for utilizing low-temperature heat by decoupling the low-temperature heat from process gas at temperatures below 200° C., wherein the decoupling takes place downstream of a hydrogen plant being a steam reformer plant, wherein the process gas is provided by the hydrogen plant and wherein the process gas is provided at a lowered intermediate temperature to a pressure swing adsorption plant located downstream of the low-temperature heat utilization assembly, the method comprising:

feeding the process gas to a first unit where a temperature of the process gas is lowered to the lowered intermediate temperature;

performing an ORC process in the first unit for decoupling the low-temperature heat and for providing electrical energy from the low-temperature heat; and feeding or exporting the electrical energy obtained in the ORC process at least one of:

to an electrical consumer unit that is coupled to the ORC process, or back within a low-temperature heat utilization process or to a process in the hydrogen plant upstream of the ORC process.

8. The method of claim 7 comprising decoupling the low-temperature heat from the process gas to the lowered intermediate temperature, wherein the process gas is lowered in a second unit in a heat exchange stage to a final temperature to provide the process gas for pressure swing adsorption.

9. The method of claim 7 comprising decoupling a heat energy flow in a range from 15MW to 40MW by the ORC process and transforming the heat energy flow into electrical energy.

10. The method of claim 7 wherein the ORC process causes a transformation of heat energy into electrical energy in a range from 1.5MW to 4.0MW with an energy transformation factor in a range of 10%.

11. The low-temperature heat utilization assembly of claim 1, wherein the steam reforming plant is configured to produce a $CH_4+H_2 \rightarrow CO+3H_2$ reaction.

12. The method of claim 7, wherein the steam reforming includes a $CH_4+H_2 \rightarrow CO+3H_2$ reaction.

* * * * *